United States Patent [19]

Wada

[11] 4,430,358

[45] Feb. 7, 1984

[54] METHOD OF MANUFACTURING A CUT TUBE TO BE USED FOR SYRINGE NEEDLES

[76] Inventor: Shoji Wada, 11-22, Katase Kaigan 2-chome, Fujisawa-shi, Kanagawa-ken, Japan

[21] Appl. No.: 327,737

[22] Filed: Dec. 4, 1981

[30] Foreign Application Priority Data

Dec. 18, 1980 [JP] Japan ..... 55-178022

[51] Int. Cl.[3] ..... B65B 33/00

[52] U.S. Cl. ..... 427/2; 427/156; 427/239; 427/235; 427/293; 427/358; 427/387; 51/227 H; 134/22.11; 128/DIG. 21

[58] Field of Search ..... 427/2, 154, 156, 235, 427/239, 293, 355, 387, 358; 128/DIG. 21, 224, 239; 51/227 H; 604/403, 130, 164, 172, 239, 240, DIG. 21; 134/40, 22.11

[56] References Cited

U.S. PATENT DOCUMENTS 2,814,296 11/1957 Everett ..... 427/2 X 3,433,662 3/1969 Webb et al. ..... 427/156 X 3,508,959 4/1970 Krahnke et al. ..... 427/2

FOREIGN PATENT DOCUMENTS 125880 of 1960 U.S.S.R. .

*Primary Examiner*—John D. Smith

*Assistant Examiner*—Bernard F. Plantz

*Attorney, Agent, or Firm*—Wenderoth, Lind & Ponack

[57] ABSTRACT

A simple and efficient method of manufacturing a syringe needle is provided herein, which involves spreading a resin solution on the entire inside and outside of a cut stainless steel tube having the dimensions of a syringe needle, hardening the resin on the inside and outside of said cut tube, removing the hardened resin from the outside of the cut tube, grinding one end of the tube with a grinder to form a main bevel, changing the contact angle between the grinder and the cut tube to form side bevels to produce a syringe needle tube having a piercing point at the ground edge of said tube, and washing away grinding materials and pollutants from the tube.

4 Claims, 6 Drawing Figures

METHOD OF MANUFACTURING A CUT TUBE TO BE USED FOR SYRINGE NEEDLES

BACKGROUND OF THE INVENTION

It is well known that the manufacture of a syringe needle involves the following steps:

(a) A stainless steel pipe conforming to the standard requirements for producing syringe needles is drawn through a die to a specified inner and a specified outer diameter.

(b) A tube thus obtained by the drawing is cut by a grinder to a length appropriate to a syringe needle. This tube is generally called a cut tube.

(c) Burrs developing and sticking on the cut section of this cut tube are removed.

(d) After the burr-removing, said cut tube is washed and dried.

(e) The cut tube is subjected to barrel-grinding to finish the outer surface of the cut tube to a smooth mirror surface and to round off the cut section.

(f) Barrel-grinding is followed by washing and drying, and in consequence a finished cut tube is obtained.

(g) The one end of each cut tube is ground by a grinder to form a main bevel at a specified angle. Next, the both sides of the main bevel are ground to form side bevels, thereby producing syringe needle tube with a piercing point at the tip.

(h) The syringe needle tube is washed and dried.

(i) At the opposite end to the side where the piercing point is formed, a needle base for inserting the syringe needle in an injector is provided and thus a crude syringe needle is obtained.

(j) The crude syringe needle is washed, dried and finally finished to a complete syringe needle.

From the nature of its use, the syringe needle should meet the following requirements: It should be sanitary; it must be safe for use; it must have a low piercing resistance to the human body; and it must offer a low resistance to the blood or the injection liquid flowing through it.

Among others, the sanitary requirement should be strictly fulfilled. Thus, when a random sampling of the mass-produced syringe needles for quality control reveals that the needle is contaminated with foreign matter such as grinder particles, metal powders or even the slightest pollution with dirty cutting oil or a detergent, the whole lot of products will be rejected as failing to meet the sanitary requirements of the syringe needles for human use.

From this standpoint, one of the most important considerations in the conventional manufacture of the syringe needles has been how to prevent the needles from being contaminated with metal powders or, grinder particles deposited inside the tube in the cutting or piercing point-forming step, or with dirty cutting oil or detergent left unflushed, before such tubes reach the market.

The cut tube is obtained by die-drawing a stainless steel pipe to a specified inner and a specified outer diameter and then cutting it to a length appropriate to be used as a syringe needle. Thereby, the drawing process is liable to leave tiny asperities and grooves on the internal tube wall, thus a rough surface is made. If in the subsequent processes of cutting and piercing point-forming, said rough surface may become contaminated with cutting oils, detergents, metal powders or grinder particles, which pollutants may defy complete removal, even by ultrasonic flushing.

Particularly in the flushing after piercing point-formation, which flushing should be carefully done to protect the formed piercing point, it would be difficult to remove said pollutants from the whole surface of the syringe needle tube.

For this reason, various devices have been tried for flushing the cut tube, syringe needle tube or syringe needle after each step of the manufacture, but no flushing method which is efficient and fully applicable for mass production has yet been realized.

As for the safety in use of the syringe needle, much importance is now attached to the reduction of the piercing resistance and the flow resistance of the needle and appropriate standards have been established. Nevertheless, the tube wall of the syringe needle is becoming increasingly thinner and syringe needles with dubious safety features are increasingly appearing on the market.

In view of this deplorable situation, the present inventor has successfully developed a method of manufacturing a cut tube for a syringe needle which can liquidate at a stroke all the difficulties encountered in meeting the above-mentioned requirements of the syringe needle for human use.

Namely, the present invention eliminates the existing problems by coating only the inner wall of cut tube with a film of hardened silicone resin and thus ensuring complete freedom of the cut tube inner wall from deposit of pollutants in all the steps of manufacture, including the barrel-grinding step, and provides for easy removal of the pollutants, even if they are deposited.

As far as the present inventor knows, there is yet no satisfactory method of manufacturing a cut tube for producing syringe needles, such as the tubes of the present invention.

SUMMARY OF THE INVENTION

The primary object of the present invention is to provide a method of manufacturing a cut tube for use as a sanitary syringe needle, in which only the inner wall of cut tube is coated with a film of a hardened silicone resin, thereby ensuring complete freedom of the cut tube inner wall from pollutants, such as metal powders, grinder particles, detergents or dirty cutting oils produced in the known various processes of manufacture. Further, the present invention provides for easy removal of these pollutants, even if they are deposited.

Another object of the present invention is to provide a method of manufacturing a cut tube to be used for a syringe needle, in which only the inner wall of cut tube is coated with a film of a hardened silicone resin, thereby ensuring stability of production with the piercing point of the tube remaining intact, even when a large number of cut tubes are formed with piercing points or washed at the same time.

Still another object of the present invention is to provide a method of manufacturing a cut tube for use as a syringe needle which is safe in use, by coating the inner wall of the cut tube with a film of hardened silicone resin, thereby minimizing the flow resistance of the syringe needle, which has an adverse effect on the flow of blood or chemical solutions in the needle, while ensuring the production of a syringe needle of required wall thickness.

To attain these objects, the invented method comprises the step of spreading a solution of a resin, such as a silicone resin, hardenable at ambient temperature or under heating, on both the entire inside and the outside of a cut tube of an adequate length; then hardening the silicone resin by leaving the cut tube thus spread with silicone resin at ambient temperature and/or heating said cut tube, thereby forming a film of hardened silicone resin on both the inside and the outside of the cut tube; and subsequently grinding the outside of the cut tube to remove said film from the outside of the cut tube.

These objects and others and the merits of the present invention will become more apparent from the following detailed description and the accompanying drawings.

BRIEF DESCRIPTION OF DRAWINGS

The accompanying drawings show the step for manufacturing a syringe needle.

DETAILED DESCRIPTION OF THE INVENTION

Figure 1:
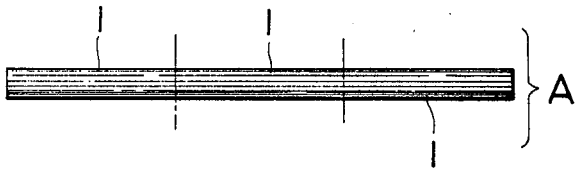
FIG. 1 is an elevation view showing the cutting of a fine stainless steel tube to a length appropriate to be used as a syringe needle.

In FIG. 1, the symbol A is a stainless steel pipe conforming to the standard requirements for producing syringe needles. This pipe was drawn through a die to a specified inner and a specified outer diameter. This stainless steel pipe is cut to an adequate length as indicated in FIG. 1. After the burrs are removed from the cut section of the cut tube 1, the cut tubes are routinely washed and dried.

A large number of cut tubes 1, thus-dried, are placed in a metal-wire basket, which is then immersed in a silicone resin solution hardenable at ambient temperature or under heating, such as a Toray Silicone SR 2411 resin.

After said solution covers the total surface of the turn on both the inside and outside of said cut tubes 1, the metal-wire basket is then lifted out of the solution.

The cut tubes 1 held in said basket are left at ambient temperature of 30 minutes to dry-up naturally. Then said basket, together with the cut tubes 1, is inserted for 15 minutes, in a conventional hot-blast furnace which is adjusted to 150° C. in respect to the blast treatment for hot-blast treatment. In this treatment, the silicone resin is perfectly hardened to form a very thin film on the total surface of the cut tube 1.

After the film formation, the above-stated cut tubes 1 are transferred from the metal-wire basket into a known barrel-trough; then by a well-known method, the outside of the cut tubes 1 are barrel-ground and in this process the film of silicone resin is removed from the outside of the cut tubes 1.

Figure 2A:
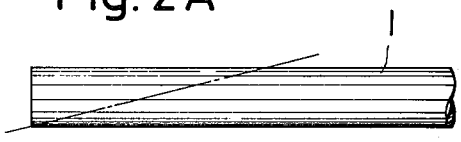
FIG. 2A is a partially enlarged elevation view showing the ground part of the main bevel on the cut tube.
Figure 2B:
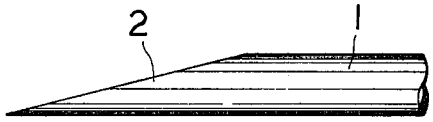
FIG. 2B is a partially enlarged elevation view showing the main bevel being grounded.
Figure 2C:
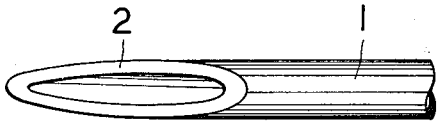
FIG. 2C is a plan view corresponding to 2B.
Figure 3A:
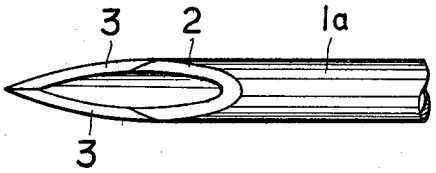
FIG. 3A is a partially enlarged plan view showing the ground part of the side bevel.
Figure 3B:
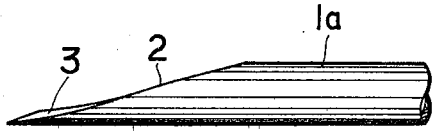
FIG. 3B is an elevation view corresponding to 3A.

This barrel-grinding is followed by routine washing and drying to yield the end product, i.e., the cut tube 1 for producing a syringe needle. The manufacture of a syringe needle from the cut tubes 1 takes place as follows: A large number of cut tubes 1 are set in parallel on a jig; using the grinder, their tips are ground at a specified angle to form the main bevel 2, as shown in FIGS. 2A, 2B and 2C; then after changing the contact angle between the grinder and the cut tube 1, both sides of the main bevel 2 are ground to form the side bevel 3, as shown in FIGS. 3A and 3B; and thus a syringe needle tube 1*a* with a piercing point can be obtained by grinding. At the opposite end to the side where the piercing point is formed, a needle base for inserting in an injector is provided and thus a crude syringe needle is obtained. The crude syringe needle is washed, dried and finally finished to a complete syringe needle.

Toray Silicone SR 2411 resin as employed in this Example possesses the general properties listed in Table 1, and after hardening, exhibits the general properties listed in Table 2.

TABLE 1

| Items | Unit | Measured values |
|---|---|---|
| Appearance | | light yellow, clear liquid |
| Specific gravity | | 0.80 |
| Non-volatiles | % | 20 |
| Viscosity | CS | below 10 |
| Time for drying to finger touch | Min | below 15 |

TABLE 2

| | Hardening conditions | |
|---|---|---|
| Items evaluated | 150° C./15 min | Ambient temperature × 24 hours |
| Cross-cut | 100/100 | 100/100 |
| Pencil hardness | H | F |
| Bending (30 × 180) | normal | normal |
| Peeling resistance (g/4 cm) | 40.0 | 20.0 |

The general properties after hardening as listed in Table 2 refer to the flow-spreading on a mild steel plate of 50 mm×100 mm×0.5 mm and the peeling resistance refers to a tape method (peeling at 180°).

It should be noted that the above-described method of manufacturing a cut tube for producing syringe needles according to the present invention is one of the preferred embodiments and is not meant to restrict the scope of the present invention.

Toray Silicone SR 2411 resin may be employed in liquid form as commercially available, or diluted 2–3 times with a diluent to reduce the thickness of hardened film.

For the purpose of spreading the hardenable silicone resin solution onto the total surface of the inside and outside surface of the cut tube any method known in the prior art may be employed, such as spraying or flow-spreading.

The silicone resin solution spread on the cut tube may be hardened by leaving it at ambient temperature, merely heating it, or as in the above example by leaving it at ambient temperature until dryness is confirmed by finger-touch, followed by a hot-blast treatment. The method can be selected, depending on the drying time, the hardness of silicone resin film and other working conditions.

It is self-evident that removal of the hardened silicone resin film formed on the outside of cut tube can be executed, as described in the above Example, with simplicity and great manpower saving by the outside grinding of the cut tube, since the film may be removed by a single step.

The practical advantages to be accrued from the adoption of the manufacturing method of producing cut tube for syringe needles according to the present invention are as follows:

(1) A film of hardened silicone resin is formed on both the inside and the outside surface of the cut tube and thereafter the film formed on the outside surface of the cut tube is easily removed by a single removal step, such as a grinding step. This method avoids the difficulty of forming such a film only on the inside surface of the cut tube, and accordingly, the process of the present invention makes for mass production of such tubes on a commercially feasible basis.

(2) A hardened silicone resin film is formed on the inside surface of the cut tube, just before a main bevel and a side bevel are imparted to the edge at one end of the cut tube. Therefore, even if foreign bodies or pollutants, such as metal powder, grinder particles or dirty cutting oils produced in the step of cutting are not completely removed in the washing step just preceeding the step of film formation, and slight amounts of the pollutants remain on the inside surface of the cut tube, such foreign bodies or pollutants will be fixed to the cut tube wall in the film-formation process at the same time as the hardening of the silicone resin, without the possibility of flowing outside.

(3) When a film of hardened silicone resin is formed on the inside surface of the cut tube, the rough inside surface of the cut tube is rendered smooth and in consequence the water repellency, oil repellency and demolding action of said film make it difficult for foreign bodies, such as metal powders, grinder particles or pollutants, such as dirty cutting oil to be deposited on the inside surface of the cut tube in the piercing point-working process. Even if they are deposited, they can be readily and safely removed by a simple washing after piercing point-working. Thus a sanitary, high-quality syringe needle tube or syringe needle can be produced efficiently with no likelihood of the products being rejected on account of damage to the piercing point after a long and laborious washing operation.

(4) The silicone resin on the inside surface of the cut tube is hardened without diffusing onto the outside surface. Therefore, when numerous cut tubes held between a set of clamps are simultaneously rolled sidewise for forming a main bevel and a side bevel, there is no possibility of the rolling motion becoming uneven or the cut tubes slipping out from between the clamps in time of working and thus the manufacture of the syringe needle tube and syringe needle is stabilized.

The syringe needle using a cut tube produced according to the present invention has a very small flow resistance and accordingly the blood or chemical solution which has previously been difficult to remove by a boiling disinfection operation after use, can be readily and completely removed. This low flow resistance renders it possible to make the wall of the cut tube thin enough to satisfy the necessary standards, thereby assuring safety of syringe needle in use. Furthermore, the low flow resistance of the tubes of the present invention means that the composition of blood suffers no change in the process of its extraction of transfusion, which in turn means that the results of blood inspection are not distorted or the blood transfused into the human body has no adverse influence.

Finally, although a silicone resin has been described in the foregoing Example, any resin can be used which can be easily coated and hardened on the surface of the cut tubes and which does not exhibit any deleterious effects on the serum or blood and within the tube and also achieves the aforementioned objectives of the present invention.

What is claimed is:

1. A method of manufacturing a syringe needle which comprises the following steps:

(a) spreading a resin solution at ambient temperatures or under heating over the entire surface inside and outside, of a cut stainless steel tube having a diameter and length conforming to the standard requirements for producing a syringe needle;

(b) hardening the resin spread over said cut tube by leaving it at ambient temperature and/or by heating the resin coated tube, thereby forming a film of hardened resin on the entire inner and outer surface of said cut tube;

(c) removing said film of hardened resin from the outside surface of said cut tube;

(d) grinding the one end of the tube with a grinder at specified angles to form a main bevel;

(e) changing the contact angle between the grinder and the cut tube to guide both sides of the main bevel to form side bevels thereby producing a syringe needle tube having a piercing point at the ground edge of said tube; and (f) washing and drying the syringe needle tube.

2. A method according to claim 1 wherein the resin is a silicone resin and wherein said resin is heated at temperatures sufficient to harden the resin.

3. A method according to claim 1 wherein the hardened resin is removed from the outside of the barrel tube by barrel grinding.

4. A method according to claim 2 wherein the hardened resin is removed from the outside of the barrel tube by barrel grinding.

* * * * *

UNITED STATES PATENT AND TRADEMARK OFFICE

CERTIFICATE OF CORRECTION

PATENT NO. : 4,430,358

DATED : February 7, 1984

INVENTOR(S) : Shoji Wada

It is certified that error appears in the above-identified patent and that said Letters Patent is hereby corrected as shown below:

On the Title page, item [76], Inventor: " after "Shoji Wada," insert -- deceased, late of --and in the last line of said paragraph, after "Kanagawa-Ken, Japan" insert-- Legal Representative: Yasuko Ohkura --.

Signed and Sealed this

Twenty-fifth Day of May, 1993

*Attest:*

Michael K. Kirk

MICHAEL K. KIRK

*Attesting Officer*

*Acting Commissioner of Patents and Trademarks*